US007111337B2

(12) United States Patent
Hong

(10) Patent No.: US 7,111,337 B2
(45) Date of Patent: Sep. 26, 2006

(54) HEIGHT-ADJUSTABLE WASHSTAND

(75) Inventor: Soon-Jin Hong, Seoul (KR)

(73) Assignee: Up & Down Systems Co., Ltd., Seoul (KR)

( * ) Notice: Subject to any disclaimer, the term of this patent is extended or adjusted under 35 U.S.C. 154(b) by 205 days.

(21) Appl. No.: 10/782,825

(22) Filed: Feb. 23, 2004

(65) Prior Publication Data

US 2005/0066438 A1 Mar. 31, 2005

(30) Foreign Application Priority Data

Sep. 29, 2003 (KR) ..... 20-2003-0030696
Sep. 29, 2003 (KR) ..... 20-2003-0030697

(51) Int. Cl.
*A47K 1/05* (2006.01)

(52) U.S. Cl. ..... 4/645; 4/566.1; 254/93 R

(58) Field of Classification Search ..... 4/559, 4/560.1, 566.1, 584, 645; 254/93 R
See application file for complete search history.

(56) References Cited

U.S. PATENT DOCUMENTS 3,011,177 A * 12/1961 Haughey ..... 4/645
3,486,175 A * 12/1969 Schwartz ..... 4/645

* cited by examiner

*Primary Examiner*—Robert M. Fetsuga
(74) *Attorney, Agent, or Firm*—Kramer & Amado, P.C.

(57) ABSTRACT

The present invention provides a bracket for a height-adjustable washstand capable of allowing the washstand to stably go up and down by providing a cylinder at the bottom of the washstand, and a hydraulic valve capable of controlling a height of the washstand by using hydraulic pressure. The height-adjustable washstand comprises a hydraulic height adjuster, the hydraulic height adjuster comprising: a cylinder vertically provided at the bottom of the washstand or on the floor to allow a washstand to go up and down; a control valve fixed to one side of the washstand to control the operation of the cylinder; a supply pipe for connecting a tap pipe and the control valve; a discharge pipe for connecting the control valve and a drain pipe; and operational pipes for connecting portions above and below an inner piston of the cylinder and the control valve, the height-adjustable washstand further comprising a bracket which comprises: a bedplate for supporting a bottom of the washstand; a guide rail for guiding the bedplate; and a support coupled to the guide rail to support the guide rail. Therefore, according to the present invention, since the washstand can be stably supported and the weight of the washstand can be distributed, the washstand is not rocked and a piston rod is not deformed when the washstand goes up and down, thereby improving the product quality.

3 Claims, 9 Drawing Sheets

Prior Art

Prior Art

Prior Art

HEIGHT-ADJUSTABLE WASHSTAND

BACKGROUND OF THE INVENTION

1. Field of the Invention

The present invention relates to a bracket and a hydraulic valve for a height-adjustable washstand. More particularly, the present invention relates to a bracket of a height-adjustable washstand for allowing the washstand to go up and down by providing a cylinder at the bottom of the washstand, and a hydraulic valve for controlling a height of the washstand by using hydraulic pressure.

2. Description of the Related Art

As well known, because the washstand for utilizing the tap water is fixed to a wall, at a predetermined height for adult, persons larger or smaller than the height, especially, children have difficulty in using the washstand of the general adult height.

In order to solve the above problem, by establishing a cylinder which is operated by oil pressure or water pressure at the bottom of the washstand, a technology allowing the washstand to go up and down has been disclosed which is illustrated in FIG. 1, FIG. 2 and FIG. 3.

Referring to FIG. 1, a cylinder 101 which is operated by oil pressure or water pressure is provided at the bottom of the washstand 100, and a piston rod 103 of the cylinder 101 is provided on the floor. Also, the cylinder 101 is connected to a control valve 105 through pressure pipes 110, the control valve 105 comprising back-force tanks 1 and 2, 106 and 107, a valve body 108 for controlling pressure of the back-force tanks 1 and 2, 106 and 107, and a switch 109 for controlling the valve body 108.

The back-force tank 1, 106 is connected to the portion above a piston 102 in the cylinder 101, and the back-force tank 2, 107 is connected to the portion below the piston 102 in the cylinder 101. Means for supplying pressure to the back-force tanks 1 and 2, 106 and 107 may be any one of an air compressor, a hydraulic pump, and an oil pressure pump connected to the control valve 105 in accordance with kinds of the cylinder 101.

Therefore, if the valve body 108 is allowed to apply pressure to the back-force tank 1, 106 through operation of the switch 109, the pressure is transferred to the portion above the cylinder 101 from the back-force tank 1, 106. However, since the piston 102 and the piston rod 103 are fixed, and the pressure at the portion above the piston 102 in the cylinder 101 is increased, cylinder 101, the control valve 105, and the washstand 100 which is coupled to the cylinder 101 go up.

Further, if pressure is applied to the back-force tank 2, 107, the pressure is transferred to the portion below the cylinder 101 from the back-force tank 2, 107, so that the cylinder 101, the control means 105, and the washstand 100 which is coupled to the cylinder 101 go down.

In this way, the height of the washstand 100 is adjusted through operation of the control valve 105, and an impact when the washstand 100 goes up and down is absorbed and mitigated by the spring 104 provided in the cylinder 101, so that a user can properly adjust the washstand 100 to his own height.

However, because the above washstand 100 is coupled to and supported by the cylinder 101 to go up and down, there is a problem that its supported state is not stable.

In other words, since the washstand 100 is supported by the cylinder 101, and the cylinder 101 is supported by the piston rod 103, most of heavy elements such as the washstand 100, the cylinder 101, and the control valve 105 are supported by the piston rod 103 of which a sectional area is very small.

Therefore, when the washstand 100 goes up and down, it is not supported enough, and the weight of the washstand 100 is concentrated to the piston rod 103, so that the washstand 100 may be rocked during going up and down, and in a worse case, the deformation of the piston rod 103 may be caused.

In the meantime, the present applicant has suggested as Korean Patent Application No. 2002-0008351 (title; Hydraulic Height Adjuster) a technique which can allow the washstand to go up and down by providing a cylinder operable by water pressure at the bottom of the washstand, which is illustrated in FIGS. 2 and 3.

In FIGS. 2 and 3, the hydraulic height adjuster 200 comprises a cylinder 202 provided below a washstand 201, and a valve 205 for operating the cylinder 202. The cylinder 202 is coupled to the floor, and the piston rod 204 of the cylinder 202 is coupled to a bottom of the washstand 201.

Further, the valve 205 is sealed with packings 208, 210 in a housing 206 in which water holes 207 are formed, and comprises a bearing 216, a valve spool 212 in which a water conduit 213 is formed, and a valve cover 217 coupled to the top portion of the housing 206.

Furthermore, in order to operate the cylinder 202, a water supply pipe 218 for connecting a tap pipe and the valve 205, a water discharging pipe 219 for connecting the valve 205 and a drain pipe, and operational pipes 220, 221 for supplying water pressure controlled by the valve 205 to portions above and below a piston 203 in the cylinder 202 are provided.

In order to operate the hydraulic height adjuster 200, firstly, the water conduit 213 is made to coincide with the water supply pipe 218 and the upper operational pipe 220 or the lower operational pipe 221 by rotating a valve handle 215 coupled to a handle fastener 214 of the valve spool 212. Then, tap water is introduced into the operational pipes 220, 221 through the water conduit 213, water grooves 209, 211 of the packings 208, 210 and the water hole 207 of the housing 206, and supplied to the portions above and below the piston 203 in the cylinder 202, so that the washstand 201 coupled to the piston rod 204 can be made to go up and down.

As a result, a user can adjust the washstand 201 to a proper height through operation of the valve handle 215.

However, the hydraulic height adjuster 200 has a complex structure, the machining of the respective parts is difficult, and thus the price for a product is increased. Further, only when the water conduit 213 correctly coincides with the water supply pipe 218 and the operational pipes 220, 221, or the water discharging pipe 219 and the operational pipes 220, 221, the supply pressure of tap water gets into maximum, so that the washstand 201 can rapidly go up and down. However, there is a problem that the operation may be delayed because it is difficult to accomplish the accuracte coincidence.

That is, because the valve spool 212 has a spherical form, the machining thereof is very difficult, and several parts are necessary for the machining. Further, if the water conduit 213 does not correctly coincide, water may be leaked from an outer circumferential surface of the valve spool 212 or from portions at which several parts are coupled, so that the operation may be delayed or an erroneous operation may happen.

SUMMARY OF THE INVENTION

The present invention is contrived to solve the above problems, and it is thus an object of the present invention to provide a bracket capable of allowing a height-adjustable washstand to be stably used by providing means for allowing the height-adjustable washstand to stably go up and down, and a hydraulic valve having a simple structure and being accurately and rapidly operated.

In order to accomplish the above object, a height-adjustable washstand according to the present invention comprises a hydraulic height adjuster, which comprises: a cylinder vertically provided at the bottom of the washstand or on the floor to allow a washstand to go up and down; a control valve fixed to one side of the washstand to control the operation of the cylinder; a supply pipe for connecting a tap pipe and the control valve; a discharge pipe for connecting the control valve and a drain pipe; and operational pipes for connecting portions above and below an inner piston of the cylinder and the control valve, the height-adjustable washstand further comprising a bracket which comprises: a bedplate for supporting a bottom of the washstand; a guide rail for guiding the bedplate; and a support coupled to the guide rail to support the guide rail.

Further, according to the present invention, the cylinder may be coupled to the bedplate, a piston rod may be coupled to the support, and a slider coupled to the guide rail to go up and down may be provided at one side of the bedplate.

Furthermore, the control valve may comprise: a body in which a plurality of connection holes are formed at one side thereof; a control plate inserted into the body, control holes arranged at the same positions as the connection holes being formed in the control plate; a valve spool in which a plurality of control grooves are formed at one surface closely attached to the control plate and a plurality of locking grooves are formed at the edges of the other surface; a control member provided at one side with locking bosses inserted into the locking grooves and provided at the other side with a lever; a seat in which a locking jaw provided between the body and the control plate is formed to prevent rotation of the control plate; an upper cover coupled to the body and provided with a penetration hole for penetrating the lever; and a valve handle coupled to the lever to rotate the control member.

Furthermore, the control valve may comprise a groove formed at one side of the control member, a pin inserted into the groove, and a spring inserted into the groove to elastically support the pin.

Furthermore, the control valve may comprise a housing in which the penetration hole is formed at its center to house the control member and the valve spool; a nut fastened to the body, a penetration hole for housing the housing being formed in the nut; a spacer in which a penetration hole into which one side of the nut is inserted is formed; a middle cover provided on the spacer; and an upper cover provided on the middle cover.

According to the above construction, since the washstand is stably supported, it does not rock when going up and down. Furthermore, since the valve has a simple structure and is accurately and rapidly operated, the product quality can be improved.

BRIEF DESCRIPTION OF THE DRAWINGS

The aforementioned aspects and other features of the present invention will be apparent from the following description taken in conjunction with the accompanying drawings, wherein.

DETAILED DESCRIPTION OF PREFERRED EMBODIMENTS

Figure 1:
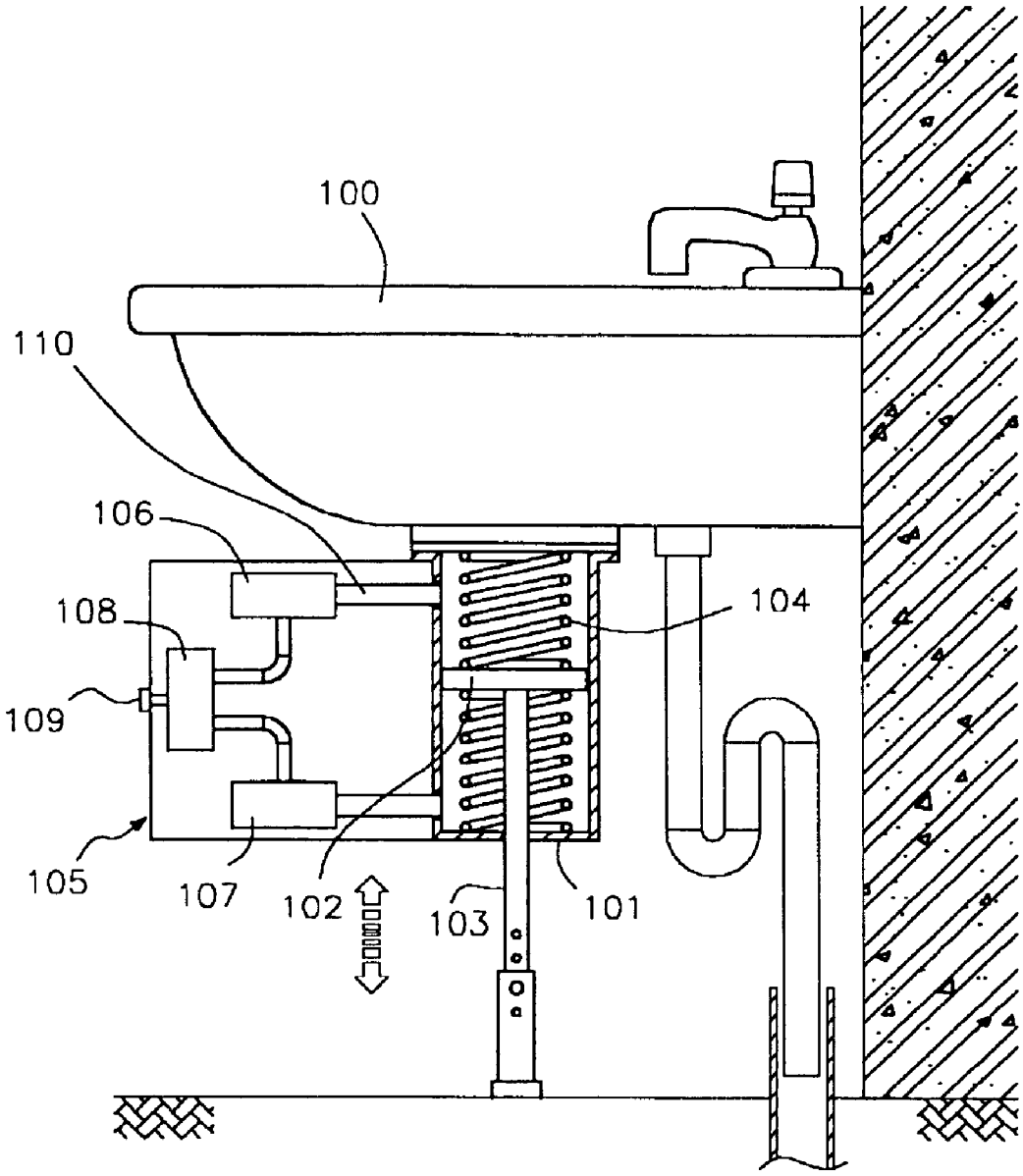
FIG. 1 is a diagram illustrating a height-adjustable means of a conventional height-adjustable washstand.
Figure 2:
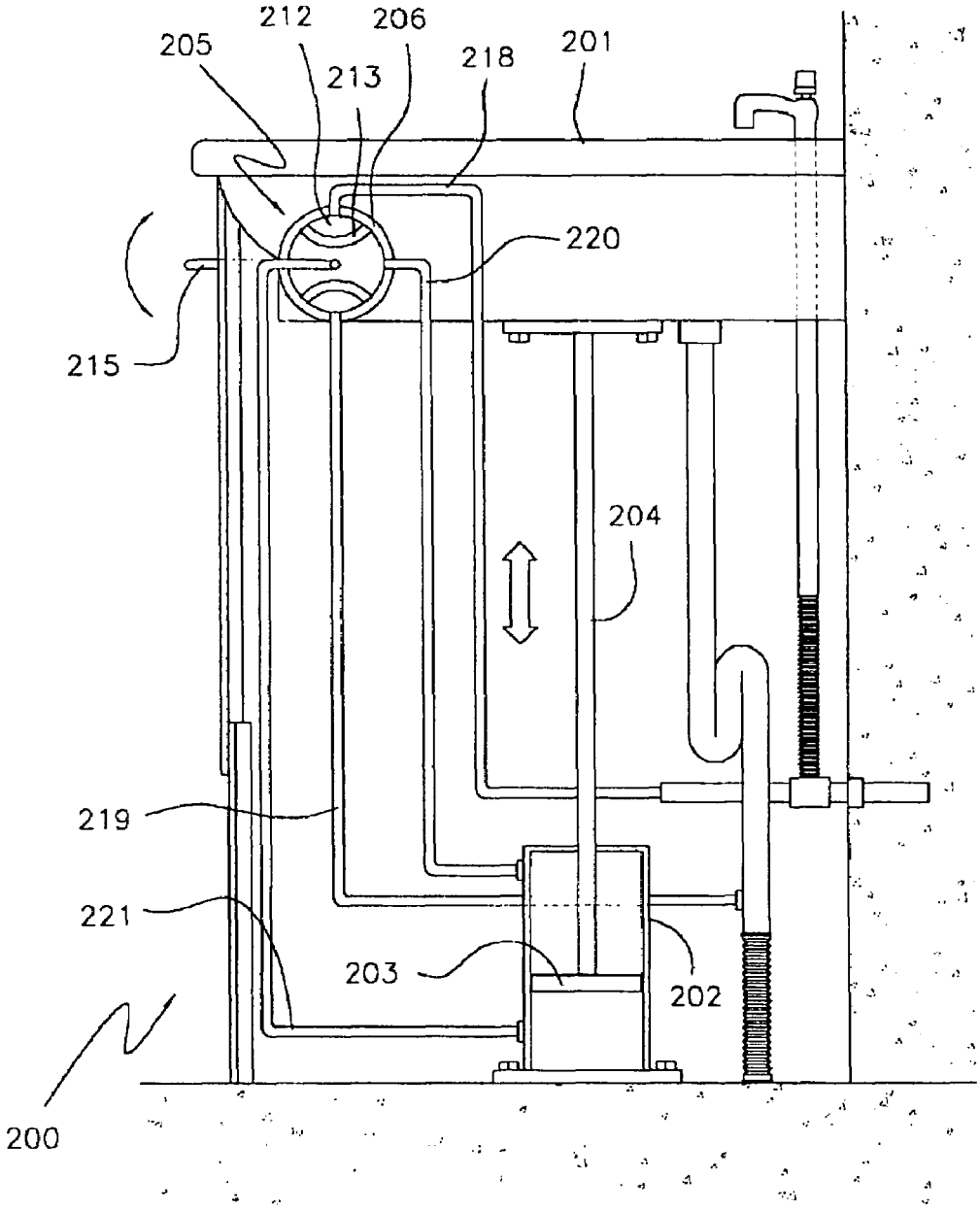
FIG. 2 is a diagram schematically illustrating a hydraulic height-adjustable apparatus of a conventional height-adjustable washstand.
Figure 3:
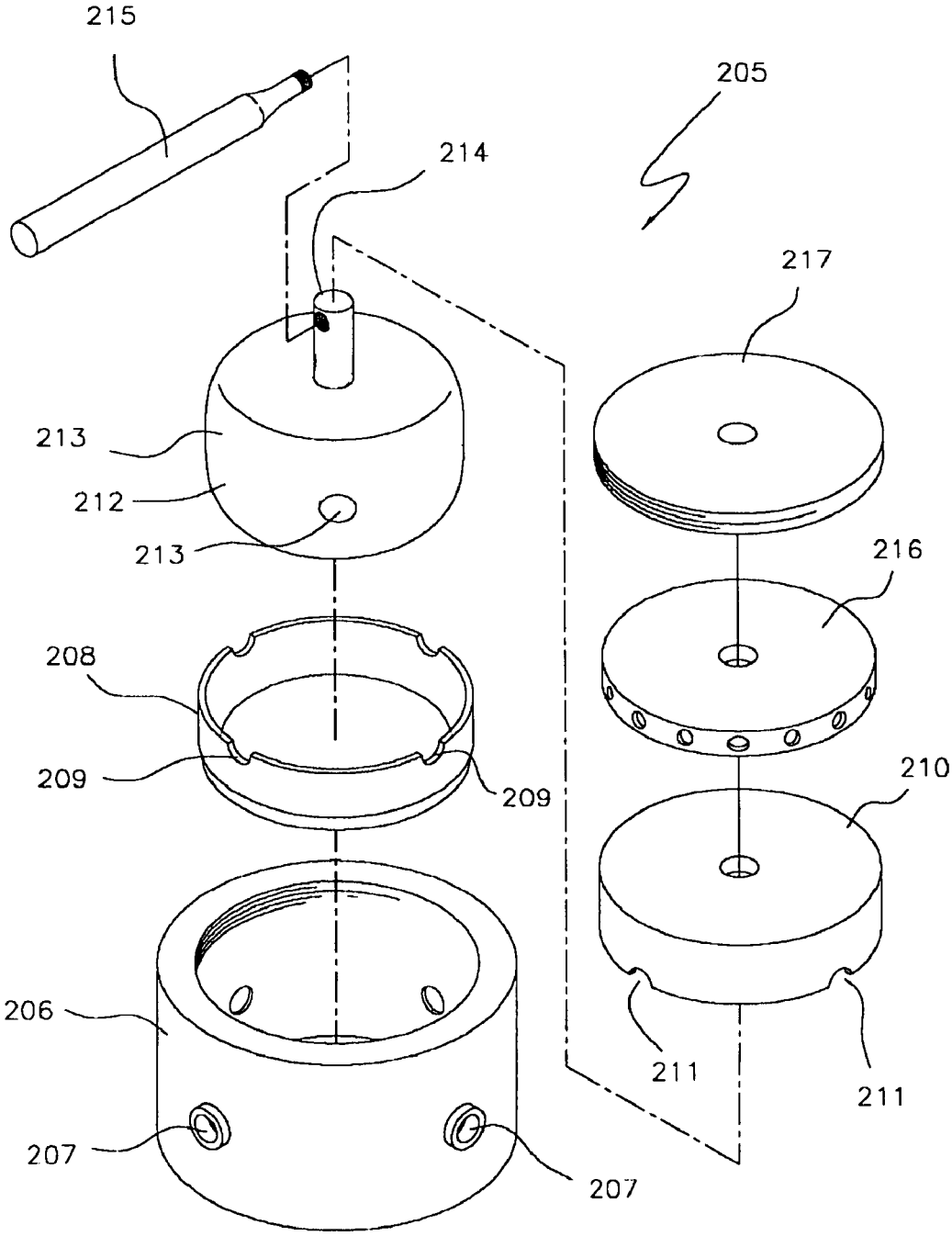
FIG. 3 is an exploded perspective view illustrating a valve of a hydraulic height-adjustable apparatus of a conventional height-adjustable washstand.

The present invention will be described in detail by way of preferred embodiments with reference to the accompanying drawings in which like reference numerals are used to identify like or similar elements.

Figure 4:
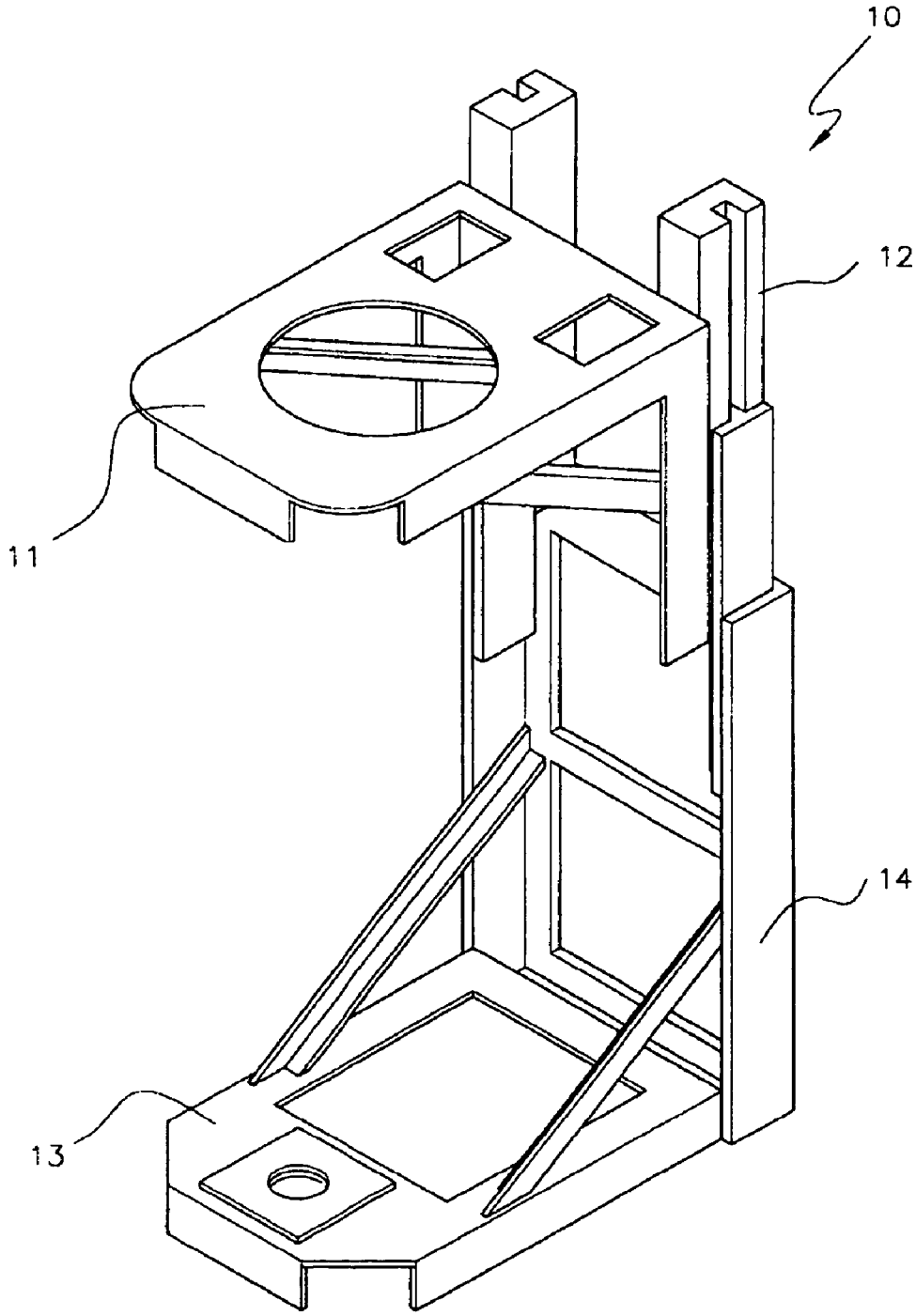
FIG. 4 is a perspective view illustrating a bracket according to the present invention.
Figure 5:
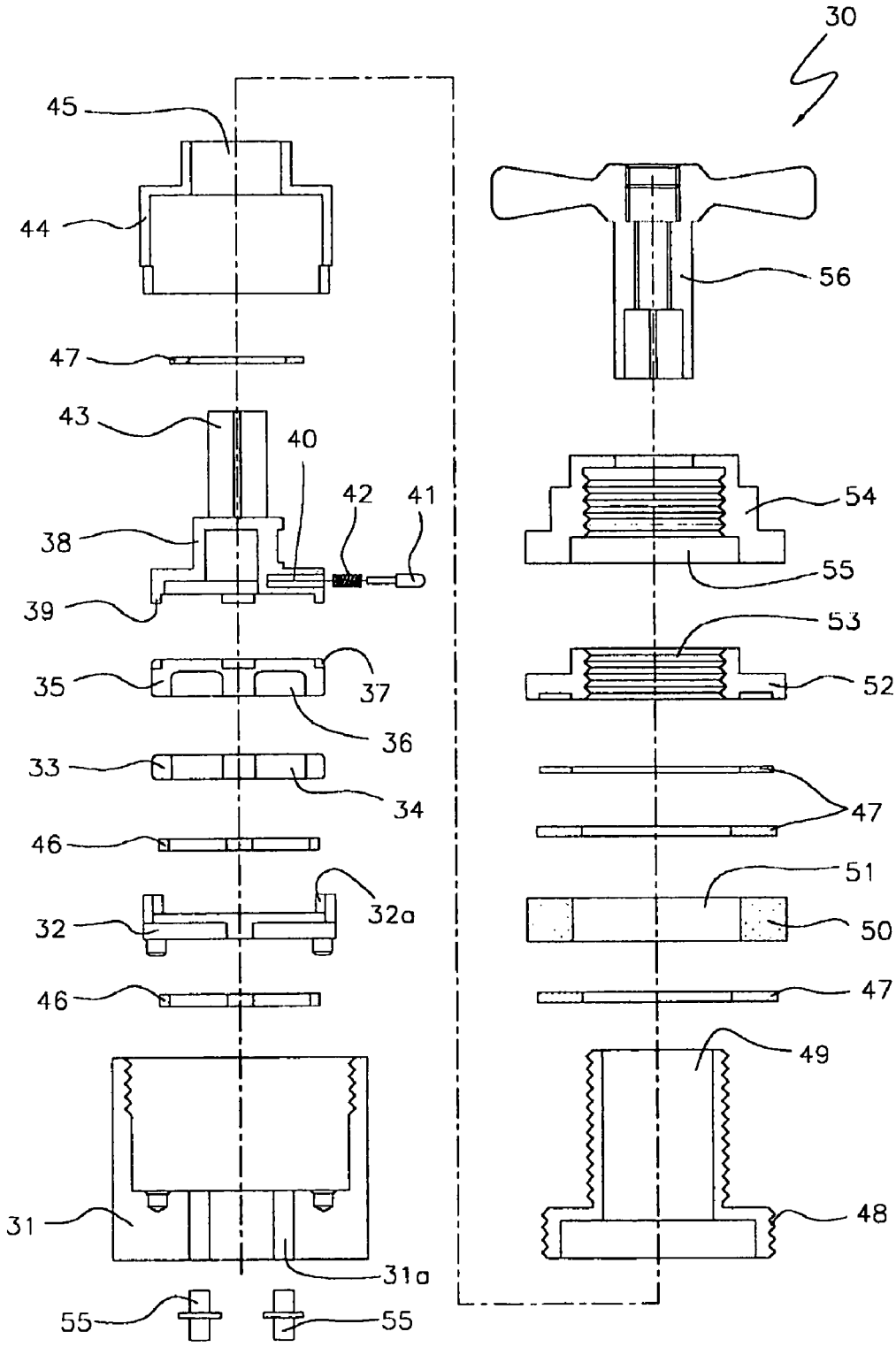
FIG. 5 is an exploded view illustrating a hydraulic valve according to the present invention.

FIG. 4 is a perspective view illustrating a bracket according to the present invention, and FIG. 5 is an exploded view illustrating a hydraulic valve according to the present invention.

The present invention provides a bracket 10 in which guide rails 14 are provided vertically at one side of a support 13 and a bedplate 11 to be guided by the guide rails 14 to go up and down is provided.

Here, a slider 12 is provided at one side of the bedplate 11, and by raising and lowering the slider 12 coupled to the guide rail 14, the bedplate 11 is allowed to go up and down.

The washstand 18 is fixed onto the bedplate 11 of the bracket 10, the support 13 is fixed to the floor, and a cylinder 15 is provided between the bedplate 11 and the support 13. Specifically, the cylinder 15 is coupled to the bottom of the bedplate 11, and a piston rod 17 is coupled to a top surface of the support 13.

Further, a control valve 30 for controlling the operation of the cylinder 15 is connected through operational pipes 19, 20 to the cylinder 15. One operational pipe 19 of the operational pipes 19, 20 is connected to the portion above an inner piston 16 of the cylinder 15, and the other operational pipe 20 is connected to the portion below the inner piston 16 of the cylinder 15.

Figure 8:
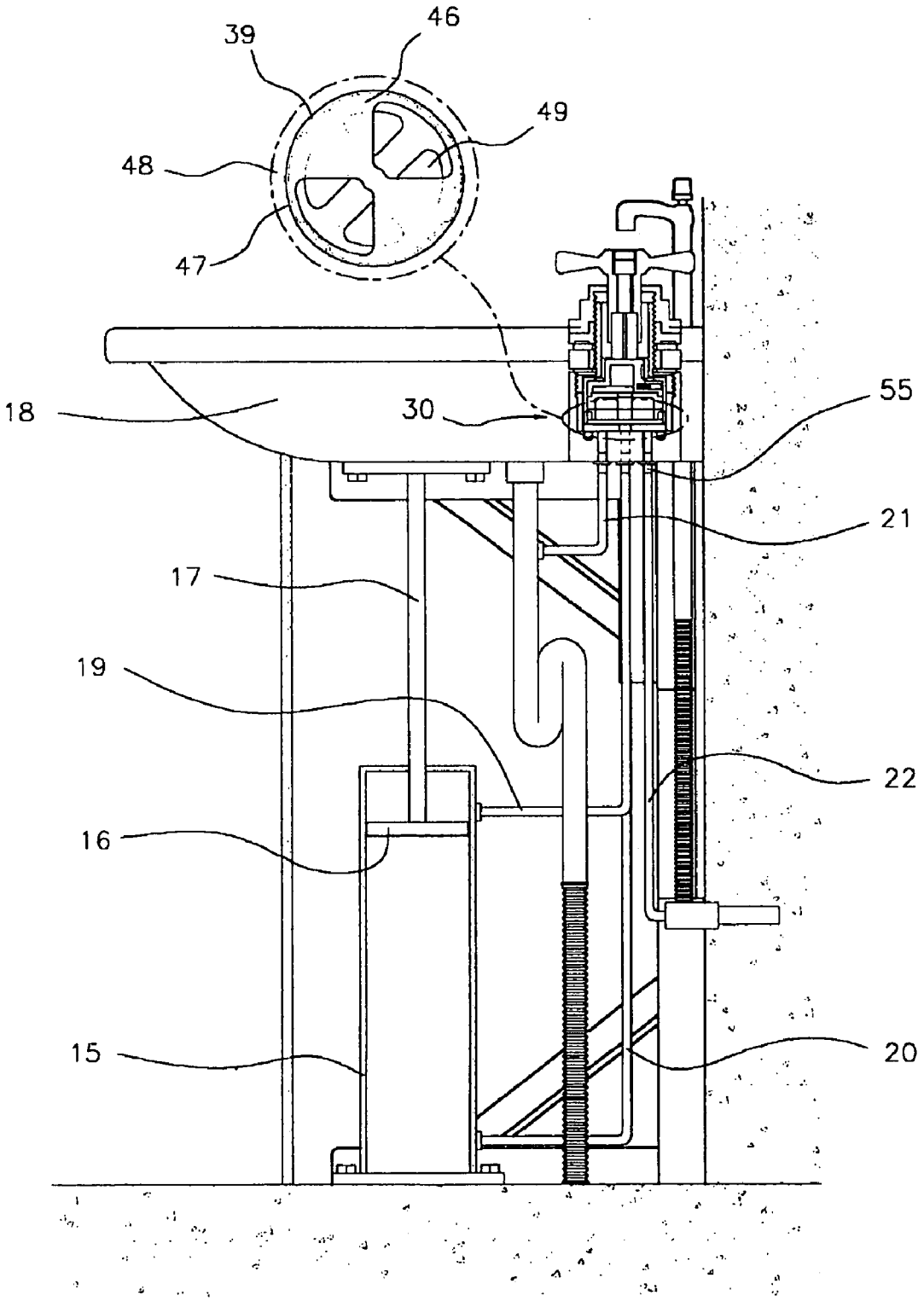
FIGS. 8 and 9 are diagrams illustrating an operation state of a cylinder by means of a hydraulic valve according to the present invention.
Figure 9:
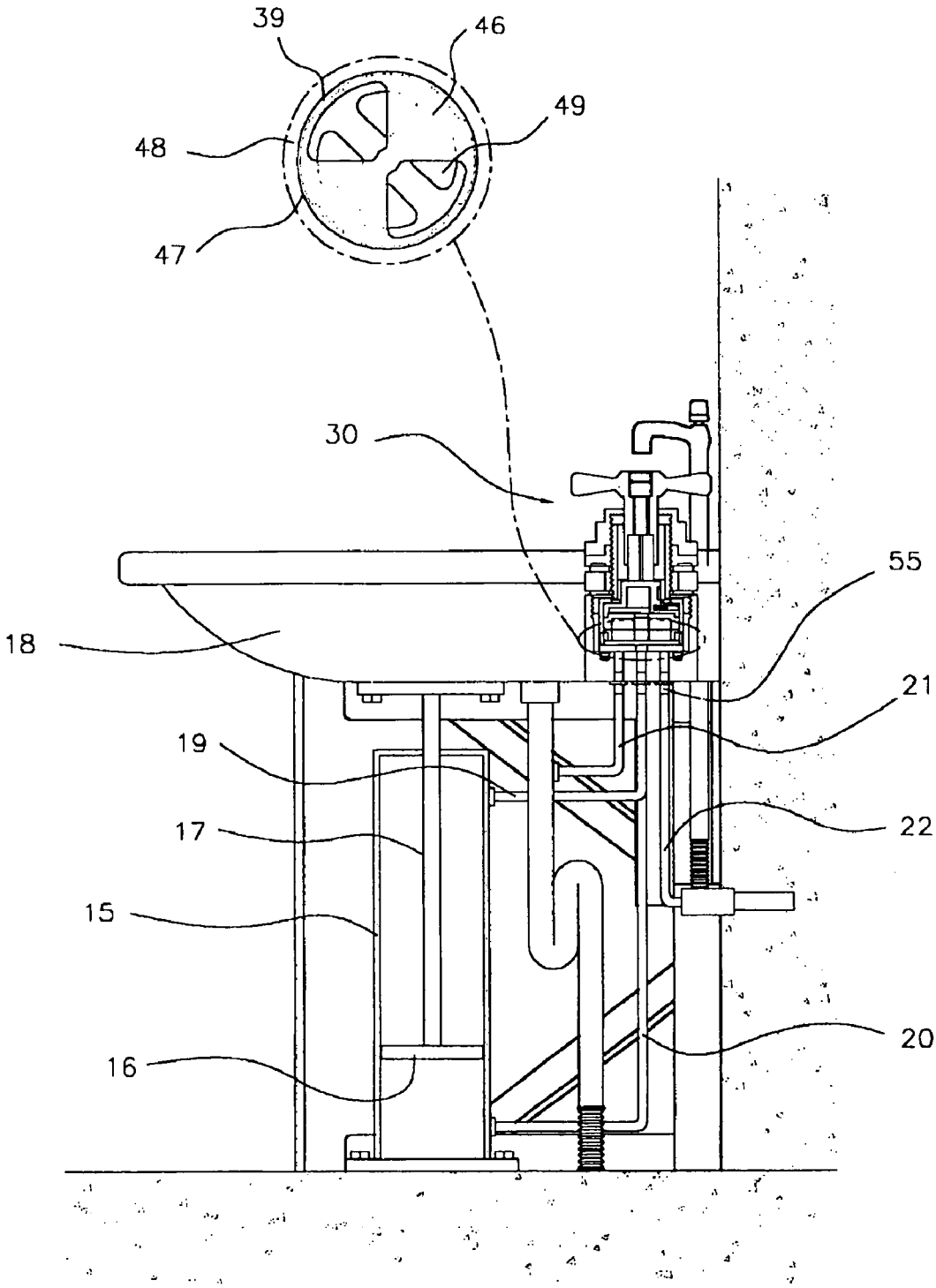

In the present invention, as shown in FIGS. 8 and 9, the cylinder 15 is operated by means of operation of the control valve 30 to make the washstand 18 go up and down. That is, firstly, when the control valve 30 is operated to supply water pressure, oil pressure, or air pressure to the portion below the inner piston 16 of the cylinder 15 through the operational pipe 20, the pressure below the inner piston 16 of the cylinder 15 is increased. However, because the inner piston 16 is fixed to the piston rod 17 coupled to the bedplate 11, the piston rod 17 goes up, and the pressure below the inner piston 16 of the cylinder 15 is discharged to the discharge pipe 21 through the operational pipe 19.

Therefore, the piston rod 17 goes up rapidly, and the bedplate 11 coupled to the piston rod 17 goes up together with the piston rod 17, so that the washstand 18 coupled to the bedplate 11 is made to go up.

Further, when the control valve 30 is operated to supply water pressure, oil pressure or air pressure to the portion above the inner piston 16 of the cylinder 15 through the operational pipe 19 the piston rod 17 goes down because the pressure above the inner piston 16 of the cylinder 15 is increased, so that the bedplate 11 and the washstand 18 also go down.

The present invention can allow the washstand 18 to go up and down through simple operation of the control valve 30. Because the bracket 10 in which the bedplate 11 and the support 13 are formed in a panel form supports the washstand 18 with a comparatively wide area, the bedplate 11 stably goes up and down together with the slider 12 coupled to and guided along the guide rail 14.

Furthermore, the weight of the washstand 18 is distributed over the guide rail 14 and the piston rod 17 without being concentrated to any certain place. Therefore, the washstand 18 is stably supported to go up and down.

Figure 6:
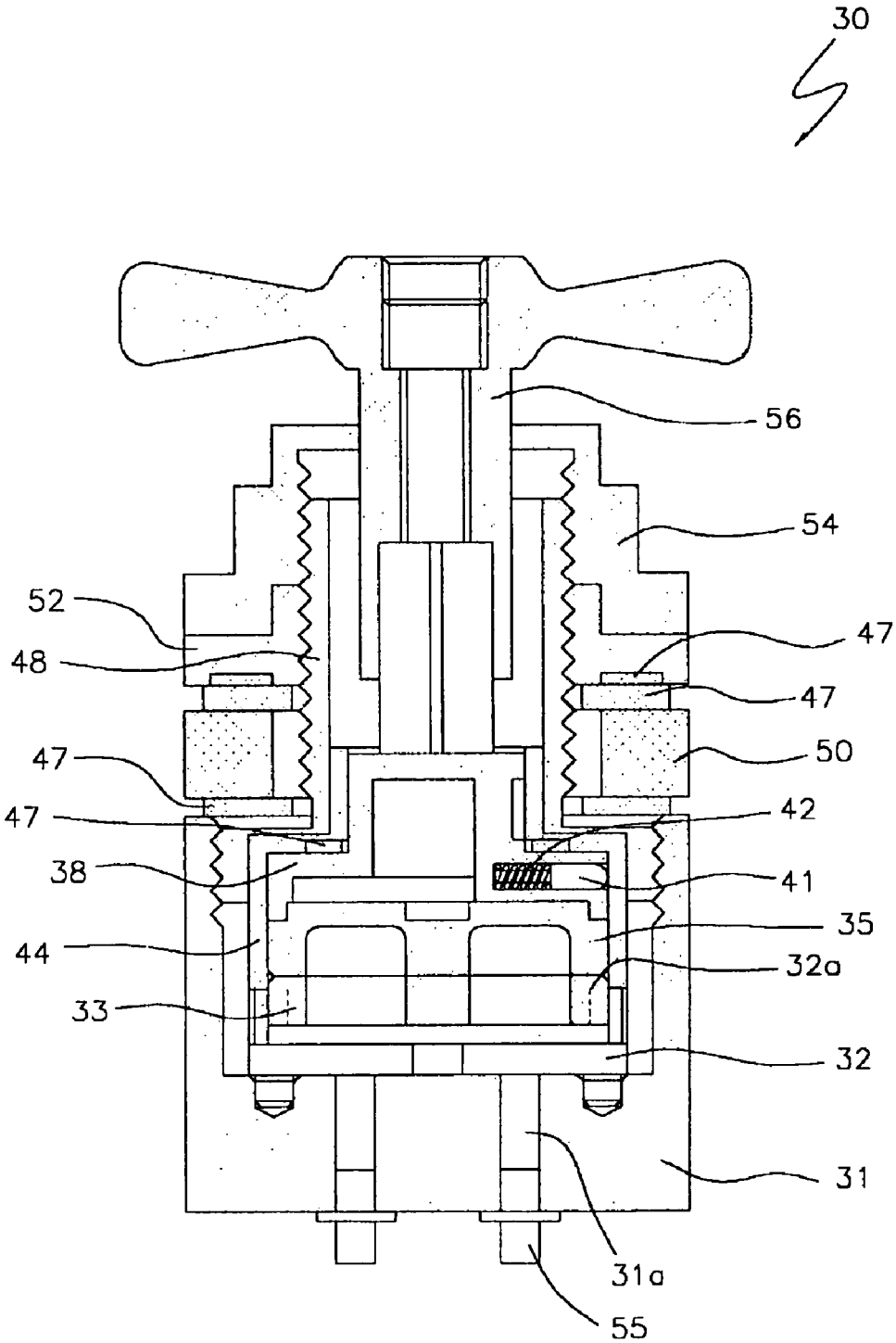
FIG. 6 is a sectional view illustrating a hydraulic valve according to the present invention.
Figure 7:
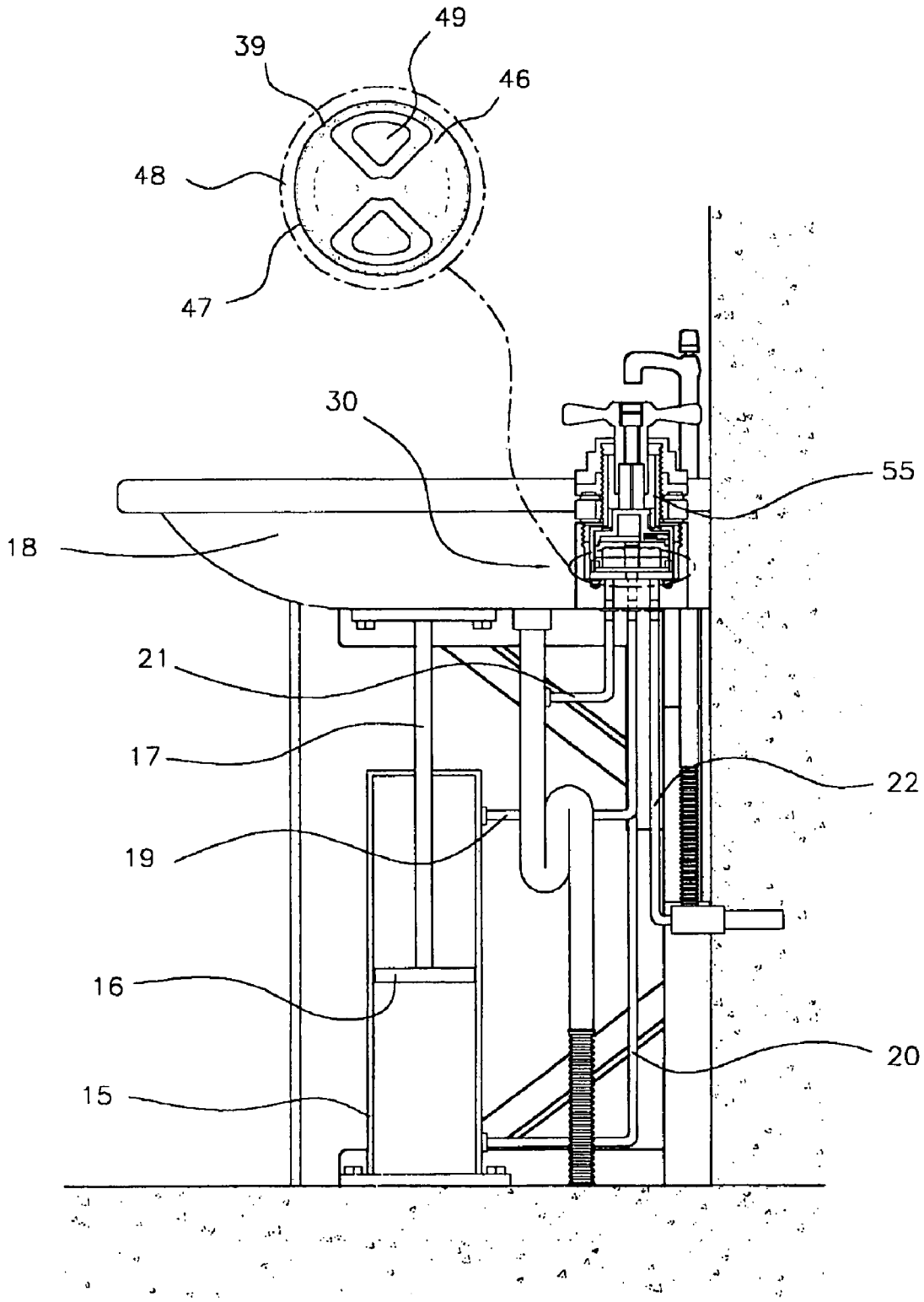
FIG. 7 is a diagram schematically illustrating a construction of a hydraulic valve according to the present invention.

FIG. 5 is an exploded view illustrating a hydraulic valve according to the present invention, and FIG. 6 is a sectional view illustrating a hydraulic valve according to the present invention.

In the present invention, the cylinder 15 is vertically provided between the bottom of the washstand 18 and the floor. Specifically, the cylinder 15 is fixed to the floor, and the piston rod 17 is coupled to the bottom of the washstand 18.

Furthermore, a control valve 30 for controlling the cylinder 15 is provided at one side of the washstand 18. Specifically, the control valve 30 sequentially comprises a seat 32 in which a plurality of connection holes 31*a* are formed at one side of a body 31 and a locking jaw 32*a* is formed inside the body 31, a control plate 33 in which control holes 34 are formed as many as the connection holes 31*a*, a valve spool 35 in which a plurality of control grooves 36 are formed at one side and a plurality of locking grooves 37 are formed at the edge of the other side, and a control member 38 in which locking bosses 39 inserted into the locking groove 37 are provided at one side and a lever 43 is formed at the other side.

Here, the packing 46 is provided for keeping watertight between the seat 32 and the body 31 and between the control plate 33 and the seat 32, and a surface of the valve spool 35 provided with the control grooves 36 and one side surface of the control plate 33 are closely attached.

Furthermore, a groove 40 is formed at one side of the control member 38, and a spring 42 and a pin 41 are inserted into the groove 40. The pin 41 is elastically supported by the spring 42, and the other end of the pin is closely attached to inner circumferential surface of the body 31.

Furthermore, the control valve 30 comprises a housing 44 and a nut 48. Here, one side of the housing 44 is inserted into the body 31, the control member 38 and the valve spool 35 are housed in the housing 44, and a penetration hole 45 through which the lever 43 is passed is formed at the center of the housing 44. Further, a penetration hole 49 fastened to the body 31 is formed in the nut 48, and houses the housing 44.

Furthermore, a spacer 50, a middle cover 52, and an upper cover 54 in which penetration holes 51, 53, 55 are formed, respectively, are sequentially fastened to the nut 48. At least one washer 47 is provided between the nut 48 and the spacer 50 and between the spacer 50 and the middle cover 52, the washer 47 is also provided between the housing 44 and the control member 38, and the lever 43 of the control member 38 sequentially passes through the penetration holes 45, 49, 51, 53, 55 of the housing 44, the nut 48, the spacer 50, the middle cover 52, and the upper cover 54. A valve handle 56 is coupled to the lever 43.

The control valve 30, as shown in FIG. 5, is provided at one side of the washstand 18, and in order to allow the control valve 30 to control the cylinder 15, the supply pipe 22 which connects the tab pipe and the control valve 30, the discharge pipe 21 which connects the control valve 30 and the drain pipe, and operational pipes 19, 20 which connect the portions above or below the inner piston 16 of the cylinder 15 and the control valve 30 are provided. Specifically, a nipple 55 is provided at each connection hole 31*a* formed in the body 31 of the control valve 30, and the supply pipe 22, the discharge pipe 21, and the operational pipes 19, 20 are coupled to the nipples 55, respectively.

According to the present invention constructed in this way, it is possible to properly adjust the height of the washstand 18 through simple operation of the valve handle 56. That is, at a neutral state, as shown in FIG. 5, the control grooves 36 of the valve spool 35 coincide with the control hole 34 connected to the supply pipe 22 and the control hole 34 connected to the discharge pipe 21, respectively, so that the supply pipe 22 and the discharge pipe 21 are in the opened state. However, since the control holes 34 connected with the operational pipes 19, 20 are closed by means of the valve spool 35, the operational pipes 19, 20 are in the closed state. Therefore, because the supply pipe 22 or the discharge pipe 21 is not connected to the operational pipes 19, 20, the pressure is not transferred to the cylinder 15, so that the cylinder 15 is not operated.

In this state, when the valve handle 56 is rotated in one direction, the control member 38 coupled to the valve handle 56, and the valve spool 35 coupled by the locking bosses 39 of the control member 38 are rotated in the same direction. As a result, as shown in FIG. 6, the control hole 34 connected to the supply pipe 22 and the control hole 34 connected to the operational pipe 20 connected to the lower side of the cylinder 15 are positioned within a range of one control grooves 36, and the control hole 34 connected to the discharge pipe 21 and the control hole 34 connected to the operational pipe 19 connected to the upper side of the cylinder 15 are positioned within the range of the other control groove 36.

Therefore, since the supply pipe 22 and the operational pipe 20 below the cylinder 15 are connected each other, and the discharge pipe 21 and the operational pipe 19 above the cylinder 15 are connected each other, the tap water supplied from the tab pipe is transferred to the portion below the cylinder 15 through the supply pipe 22 and the operational pipe 20, thereby applying the pressure to the portion below the piston 16.

Accordingly, the piston 16 goes up, and as a result, the piston rod 17 and the washstand 18 go up. At this time, the tap water above the inner piston 16 of the cylinder 15 is discharged to the drain pipe through the operational pipe 19 and the discharge pipe 21.

On the other hand, when the valve handle 56 is rotated in the other direction, the valve spool 35 is rotated in the direction different from the one direction. Therefore, as shown in FIG. 9, the control hole 34 connected to the supply pipe 22 and the control hole 34 connected to the operational pipe 19 connected to the portion above the cylinder 15 are positioned within the range of one control groove 36, and the control hole 34 connected to the discharge pipe 21 and the control hole 34 connected to the operational pipe 20 connected to the portion below the cylinder 15 are positioned within the range of the other control groove 36.

Therefore, the tap water is supplied to the portion above the inner piston 16 of the cylinder 15, thereby applying the pressure to lower the piston 16. As a result, the tab water below the piston 16 is discharged to the drain pipe, and the washstand 18 goes down.

In this way, according to the present invention, it is possible to adjust the height of the washstand 18 by changing a position of the control groove 36 of the valve spool 35, and since the structure is simple, a less number of parts is necessary. Further, in rotating the valve spool 35, since the locking jaw 32*a* formed to the seat 32 prevents the control plate 33 from being rotated together with the valve spool 35, and the pin 41 inserted into the groove 40 of the control member 38 and elastically supported by the spring 42 prevents the valve spool 35 from being rotated arbitrarily, erroneous operation does not occur.

Although the present invention has been described with reference to the embodiments shown in the drawings, the embodiments are only for exemplification, and the present invention can be applied to a sink, a toilet bowl, a toilet seat and others.

As mentioned above, according to the present invention, a bracket capable of stably supporting a washstand to guide up-and-down movement of the washstand is provided under the washstand. As a result, the washstand is stably supported and the weight of the washstand is distributed, so that when the washstand goes up and down, the washstand is not rocked and the piston rod is not deformed, thereby improving the product quality.

Further, by simplifying the structure of the valve and reducing the number of elements, the machining and the assembling of the product can be facilitated, and the cost can be reduced. Furthermore, due to the simplification of elements, the leakage of water from portions between the elements is prevented, and by positioning the control holes within the range of the control grooves, the supply and discharge of water can be rapidly performed, so that the supply pressure of the tab water can be transferred to the cylinder without loss, and the washstand can rapidly go up and down.

What is claimed is:

1. A height-adjustable washstand comprising a hydraulic height adjuster, the hydraulic height adjuster comprising:

a cylinder vertically provided at the bottom of a washstand or on the floor to allow the washstand to go up and down;

a control valve fixed to one side of the washstand to control the operation of the cylinder;

a supply pipe for connecting a tap pipe and control valve;

a discharge pipe for connecting the control valve and a drain pipe; and a first operational pipe, for connecting the portion above an inner piston of the cylinder and the control value; and a second operational pipe for connecting the portion below an inner piston of the cylinder and the control valve;

wherein water is supplied to one of the portion above the inner piston and the portion below the inner piston through the supply pipe and the control valve while water is discharged from the other portion among the portion above the inner piston and the portion below the inner piston through the discharge pipe and the control valve, thereby the washstand is allowed to go up and down only by hydraulic pressure difference, wherein the control valve comprises:

a body in which a plurality of connection holes are formed at one side thereof;

a control plate inserted into the body, a control hole arranged at the same positions as the connection holes being formed in the control plate;

a valve spool in which a plurality of control grooves are formed at one surface closely attached to the control plate and a plurality of locking grooves are formed at the edges of the other surface;

a control member provided at one side with locking bosses inserted into the locking grooves, and provided at the other side with a lever;

a seat in which a locking jaw provided between the body and the control plate is formed to prevent rotation of the control plate;

an upper cover coupled to the body, a penetration hole for penetrating the lever being formed in the upper cover; and a valve handle coupled to the lever to rotate the control member.

2. The height-adjustable washstand according to claim 1, further comprising a groove formed at one side of the control member, a pin inserted into the groove, and a spring inserted into the groove to elastically support the pin.

3. The height-adjustable washstand according to claim 1, further comprising:

a housing in which a penetration hole is formed at the center thereof and which houses the control member and the valve spool;

a nut fastened to the body, a penetration hole for housing the housing being formed in the nut;

a spacer in which a penetration hole into which one side of the nut is inserted is formed;

a middle cover provided on the spacer; and an upper cover provided on the middle cover.

* * * * *